US005318278A

United States Patent [19]

Bettinger et al.

[11] Patent Number: 5,318,278

[45] Date of Patent: Jun. 7, 1994

[54] APPARATUS FOR MAKING MIXTURES OF REACTIVE MELTS

[75] Inventors: Rolf Bettinger, Juchen; Klaus Seidler, Grevenbroich; Wolfgang Vogel, Meckenheim; Manfred Fortmann, Much; Dirk Möller, Bargisch-Gladbach, all of Fed. Rep. of Germany

[73] Assignee: Vaw Aluminium AG, Bonn, Fed. Rep. of Germany

[21] Appl. No.: 908,667

[22] Filed: Jul. 2, 1992

[30] Foreign Application Priority Data

Jul. 5, 1991 [DE] Fed. Rep. of Germany ..... 4122319

[51] Int. Cl.[5] ..... C22B 21/04

[52] U.S. Cl. ..... 266/216; 75/678; 75/680; 266/217; 266/225

[58] Field of Search ..... 75/414, 678, 680; 266/216, 225, 217

[56] References Cited

U.S. PATENT DOCUMENTS

| | | | |
|---|---|---|---|
| 2,678,266 | 5/1954 | Zifferer | 266/216 |
| 4,248,630 | 2/1981 | Balmuth et al. | 75/135 |
| 4,511,398 | 4/1985 | Kugler | 75/678 |
| 4,556,535 | 12/1985 | Bowman et al. | 420/528 |
| 4,565,573 | 1/1986 | Symonds et al. | 266/216 |
| 4,761,266 | 8/1988 | Bruski | 420/528 |
| 4,767,598 | 8/1988 | Kinosz et al. | 420/528 |

FOREIGN PATENT DOCUMENTS 361058 10/1922 Fed. Rep. of Germany .

*Primary Examiner*—Melvyn J. Andrews
*Attorney, Agent, or Firm*—Darby & Darby

[57] ABSTRACT

A method for the preparation of a mixture of at least one reactive element or an alloy thereof and a liquid metal melt, including introducing the reactive element or alloy thereof, in a liquid state and under pressure, within, i.e. below the surface of, the metal melt, is provided. An apparatus to facilitate the method above is also provided. The apparatus includes a crucible, an immersion pipe that passes into the crucible, an accommodating vessel for storing the reactive element or alloy thereof and a pressure unit.

14 Claims, 1 Drawing Sheet

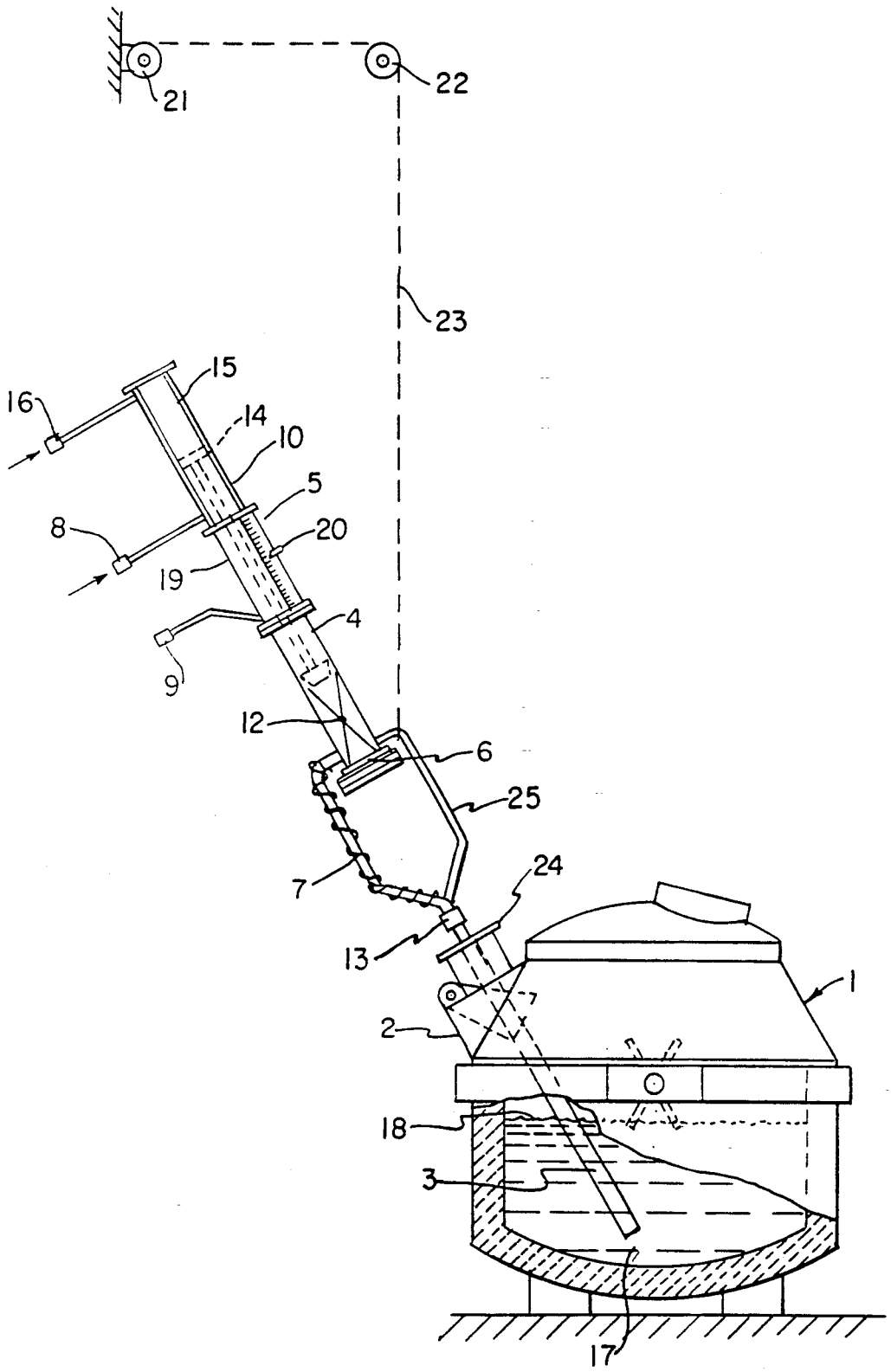
21
22
23
15
16
14
10
5
8
20
19
4
9
12
6
25
7
24
13
1
2
18
3
17

APPARATUS FOR MAKING MIXTURES OF REACTIVE MELTS

FIELD OF INVENTION

This invention relates to a method for preparing mixtures of liquid metal melts and reactive elements, as well as to an apparatus useful therein.

BACKGROUND OF THE INVENTION

Reactive elements are used to treat metal melts in order to improve the microstructure of the melt. Reactive elements such as sodium metal in salt form, tablet form, or other solid processing forms such as a solid alloy have been added to aluminum melts as described in "Aluminium-Taschenbuch" (Aluminum Handbook, 14th Ed. page 385). The sodium containing form is decomposed slowly to release sodium in the melt over prolonged periods of time. Typically, the release and the reaction of the reactive metal, and particularly sodium, occurs in air and over a prolonged period of time. This results in oxidation of the reactive element, and consequently, significant formation of oxides in the metal melt.

BRIEF DESCRIPTION OF THE DRAWINGS

FIG. 1 is a cross sectional view of an apparatus according to the present invention.

SUMMARY OF THE INVENTION

A method for the preparation of a mixture of at least one reactive element or an alloy thereof and a liquid metal melt, the method comprising introducing the reactive element or alloy thereof, in a liquid state and under pressure, within, i.e. below the surface of, the metal melt, is provided.

The invention also contemplates an apparatus to facilitate the method above. The apparatus of the present invention comprises a crucible having an interior adapted to contain the metal melt. The crucible has an opening which is adapted to access the interior of the crucible in order to add materials to any metal melt in the crucible. An immersion pipe that is adapted for introducing the reactive metal or alloy thereof to the melt, is provided. The immersion pipe has an end exterior to the crucible and an end interior to the crucible. The immersion pipe passes through the addition opening in the crucible so that the exterior end of the pipe is outside of the crucible and the interior end of the pipe is inside the crucible. The immersion pipe is in communication with an accommodating vessel that has a proximal and a distal end with respect to the crucible. The accommodating vessel is adapted to store the reactive element or alloy thereof. The proximal end of the accommodating vessel is optionally adapted for heating the reactive metal or alloy thereof. The distal end of the accommodating vessel is in communication with a pressure unit that is adapted to exert pressure on the reactive metal or alloy thereof and/or through the immersion pipe in the direction of the crucible.

Because the reactive element or alloy thereof is delivered to the metal melt in liquid form, precise metering is possible and because the reactive element is delivered within the melt and with an inert gas under a suitable pressure, oxidation is minimized.

DETAILED DESCRIPTION OF THE INVENTION

The reactive element or alloy thereof is introduced to the metal melt in a liquid state. Preferably, the liquid state of the reactive element or alloy thereof is reached only immediately before the addition to the metal melt (proximate liquification).

The apparatus for carrying out the method of the present invention comprises a crucible, an immersion pipe, an accommodation vessel, and a pressure unit. Suitable crucibles include gutters and furnace forms as well. Preferred crucibles are provided with an impeller to improve mixing and the reactive element or alloy thereof is preferably delivered to the impeller intake region.

The immersion pipe is a hollow tube which passes through an opening in the crucible and penetrates the metal melt. Therefore, a portion of the immersion pipe, in the operating position, remains outside the crucible, the end of which is the exterior end of the immersion pipe, while another portion is inside the crucible, the end of which is the interior end of the immersion pipe. The exterior end of the pipe is in communication with an accommodating vessel which series as a reservoir for the reactive element or alloy thereof. Alternatively, the exterior end of the pipe is in communication with an intermediate pipeline which is in between and in open communication with both the accommodating vessel and the immersion pipe. Additionally, the intermediate pipeline can be heatable. Proximate liquification can be effected preferably by heating the reactive metal or alloy thereof with a heating plate situated at the proximal end of the accommodating vessel. Furthermore, the immersion pipe can be heated. One or more of these components are preferably heated to assure that the liquified state is maintained throughout the passage of the reactive metal or alloy thereof to the metal melt.

The heating unit at the proximal end of the accommodating vessel and any optional conduit(s), with or without heating devices, connecting the accommodating vessel with the immersion pipe can include a means for measuring temperature change. Additionally, a means for indicating temperature may be incorporated in the pressure unit described below.

The metal melt is prevented from rising or backing into the immersion pipe, optional conduit or intermediate pipeline, and/or the accommodating vessel, by a blocking stream of gas. Blocking gases for prevention of penetration of the metal melt into the immersion pipe, optional conduit or intermediate pipeline, and/or the accommodating vessel include the inert gases. Preferred blocking gases are nitrogen or argon.

The immersion tube must penetrate below the surface of the metal melt and preferably it protrudes into the lower plane of the metal melt.

Although the pressure for conveying the reactive element or alloy thereof through the immersion pipe and to the melt can be provided by any means known in the art, preferably the pressure is produced by a pressure unit. The pressure unit preferably comprises a pressure cylinder, which most preferably is a two-stage cylinder. The pressure is generally produced by a stream of inert gas.

The pressure provided by the inert gas can be followed by a further pressure provided by pneumatic cylinder which can be disposed above or at the distal end of the accommodating vessel. The pressure in the pneumatic cylinder can manipulate a piston rod which acts on the reactive element or alloy thereof. The pressure from either or both sources can be maintained even after the reactive element has been conveyed into the metal melt by the inert gas stream, mechanical, and/or air pressure.

When a two-stage cylinder is provided, an inert gas may be used for a first stage pressurization and normal compressed air may be used for a second stage pressurization. Preferably, the inert gas and/or the compressed air is introduced into the system through pressure lines. The reactive element or alloy thereof can be metered into the metal melt by controlling the pressure ranges or combinations of inert gas and/or compressed air or by means of a shut-off valve(s) preferably positioned at the area of the pressure line(s) that enter into the immersion pipe. Most preferably, pressure is controlled by quantity controllers and shut-off fittings.

Since the immersion pipe, any intermediate connecting conduits, the accommodating vessel, and any other components of the apparatus are exposed to severe erosive and corrosive attack, it is desirable to provide all pipelines with internal protection.

The invention is described in greater detail by reference to FIG. 1. An immersion pipe (3) extends into the lower region (17) of the metal melt contained in the crucible furnace (1). An opening (2) in the crucible furnace (1) permits the through passage of the immersion pipe (3). Seals (24) may be used to main the integrity of the crucible. The immersion pipe (3) is connected by an intermediate pipe or a conduit (7), which may be heated, with the accommodating vessel (4) containing the reactive element or alloy thereof. A coupling (13) may be disposed between the conduit (7) or the accommodating vessel and the immersion pipe (3). This coupling can be used to regulate the flow of reactive metal or alloy thereof from the accommodating vessel (4) to the immersion pipe (3) or to interrupt the connection from the accommodating vessel (4) to the immersion pipe (3) whether the connection is direct or through an intermediate pipe.

A heating means, such as a hot plate (6), can be positioned at the proximal end of the accommodating vessel (4) to aid in liquefying the reactive element or alloy thereof (12) or to maintain the liquidity of a liquified product.

In the accommodating vessel (4), a pressure plate (11) is biased against the surface of the reactive element or alloy thereof to direct the reactive element or alloy thereof through the immersion tube and in the direction of the metal melt. The pressure plate (11) can be moved in response to a pressure unit (5).

The pressure unit (5) includes a cylinder (10) and two inlet openings (8, 9) for inert gas and/or compressed air. The movement of the pressure plate (11) and thus the amount of reactive element or alloy thereof delivered to the melt can be observed by an indicating device (20).

In FIG. 1, the pressure unit (5) is of a 2-stage type wherein the pressure plate (11) and a piston (14) are connected over a piston rod (19). Typically, an inert gas stream is introduced into the accommodating vessel (4) through the inlet openings (9). When the reactive element or alloy thereof (12) is liquified, preferably by the heating element (6), the reactive element or alloy thereof (12) is conveyed through the heated pipeline (7) and the immersion pipe (3) into the melt (18).

To increase the melting rate of the reactive element or alloy thereof, compressed air, preferably at a pressure of about 2 bar, can be introduced through an addition inlet valve (16) into the cylinder space (15) of the pressure cylinder (10). At the same time, the pressure plate (11) can be advanced so that the reactive element or alloy thereof is pressed against the heating element (6).

Compressed air can also be supplied to the cylinder (10) through a pipeline (8) to move the piston (14) upwards. The pressure plate (11) moves simultaneously with the piston due to the action of the piston rod (19). The heating element can be cooling during this step.

After the liquid reactive element or alloy thereof has been delivered to the metal melt, the apparatus can be removed from the crucible furnace (1) by suitable means known to those in the art such as by a hoisting winch (21) and a deflector roll (22). A rope can be fastened to a transport hoop (25) to aid in removal.

With the above-described method and apparatus, it is possible to deliver precisely 1 kg of sodium in 10 minutes while avoiding the disadvantages detailed above.

DESCRIPTION OF THE PREFERRED EMBODIMENT

Example 1

Addition of Liquid Sodium to an Aluminum Melt

At the start of mixing, nitrogen is supplied over the pipeline (9) into the system to flush the accommodating vessel, the connecting pipes, and the immersion pipe. Nitrogen for the flushing is supplied at 0.5 to 1.5 L/min at a pressure of 1.5 to 2.5 bar.

At the end of the flushing treatment, the heating element of the pipeline (7) is raised to a temperature ranging from 200° to 400° C. The contacting pressure is then adjusted by a piston (11) to 1.5 to 2.5 bar. The temperature of the heating element (6) is then adjusted to about 200°±10° C. and the inert gas conveying stream is set at 4 to 6 L/min.

The sodium is liquified and introduced to within the aluminium melt of sodium. The resulting amount conveyed can be read on the scale (20). Adjustment parameters are the temperatures and the cylinder pressures. These are measured as is known to one of ordinary skill in the art.

The above mentioned publication and test methods are hereby incorporated by reference.

Many variations of the present invention will suggest themselves to those skilled in the art in light of the above detailed description. All such obvious variations are within the intended scope of the appended claims.

What is claimed is:

1. An apparatus for introducing a liquid reactive element or alloy thereof to within a liquid metal melt, said apparatus comprising (a) a crucible (1) having an interior adapted for containing said metal melt, and having an opening (2) through said crucible adapted for accessing the interior of said crucible, (b) an immersion pipe adapted for introducing said reactive metal or alloy thereof to within said melt, said pipe having an end exterior to said crucible and an end interior to said crucible, and passing through said opening (2), said immersion pipe being in communication with (c) an accommodating vessel (4) having an end proximal to said crucible and an end distal to said crucible, said vessel being adapted for storing said reactive element or alloy thereof, (d) a pressure unit (5) at said distal end or said vessel adapted for exerting pressure through said immersion pipe and in the direction of said crucible (1), and (e) a heating plate (6) disposed at said proximal end of said accommodating vessel (4) for heating said reactive metal or alloy thereof.

2. An apparatus as defined in claim 1, wherein a heatable pipeline (7) adapted for passing said reactive element or alloy thereof to said metal melt, is disposed between and in communication with said immersion pipe (3) and said accommodating vessel (4).

3. An apparatus as defined in claim 1, wherein said pressure unit (5) comprises a sealed cylinder (10) having a lower end, at least one inlet opening (8, 9), and a pressure plate (11) at said lower end of said cylinder (10), said pressure plate (11) being adapted for pressing against said reactive element or alloy thereof (12).

4. An apparatus as defined in claim 2, wherein a coupling adapted for regulating the flow of reactive metal or alloy thereof or for interrupting the connection from said accommodating vessel to the interior of said crucible, is disposed between said heatable pipeline (7) and said immersion pipe (3).

5. An apparatus as defined in claim 3, wherein a piston (14) is disposed above said pressure plate in said cylinder (10), said cylinder having a pressure space (15) above said piston (14) into which compressed air can be supplied through an air inlet (16).

6. An apparatus as defined in claim 1, having an impeller having an intake region disposed in said interior of said crucible, wherein said immersion pipe (3) extends into said intake region (17) of said impeller.

7. An apparatus as defined in claim 1, wherein said immersion pipe (3) is protected internally against erosion.

8. An apparatus as defined in claim 1, wherein said immersion pipe is adapted to receive a blocking gas to prevent penetration into said pipe of any metal melt from the interior of said crucible.

9. An apparatus as defined in claim 5, wherein said pressure plate (11) and said piston (14) are connected by a piston rod (19).

10. An apparatus for introducing a liquid reactive element or alloy thereof to within a liquid metal melt, said apparatus comprising (a) a crucible (1) having an interior adapted for containing said metal melt, and having an opening (2) through said crucible adapted for accessing the interior of said crucible, (b) an immersion pipe adapted for introducing said reactive metal or alloy thereof to within said melt, said pipe having an end exterior to said crucible and an end interior to said crucible, and passing through said opening (2), said immersion pipe being in communication with (c) an accommodating vessel (4) having an end proximal to said crucible and an end distal to said crucible, said vessel being adapted for storing said reactive element or alloy thereof, said proximal end optionally being adapted for heating said reactive metal or alloy thereof, and (d) a pressure unit (5) at said distal end or said vessel adapted for exerting pressure through said immersion pipe and in the direction of said crucible (1), said pressure unit (5) comprising a sealed cylinder (10) having a lower end, at least one inlet opening (8, 9), and a pressure plate (11) at said lower end of said cylinder (10), said pressure plate (11) being adapted for pressing against said reactive element or alloy thereof (12).

11. An apparatus as defined in claim 10, wherein a piston (14) is disposed above said pressure plate in said cylinder (10), said cylinder having a pressure space (15) above said piston (14) into which compressed air can be supplied through an air inlet (16).

12. An apparatus as defined in claim 1, wherein said pressure plate (11) and said piston (14) are connected by a piston rod (19).

13. An apparatus for introducing a liquid reactive element or alloy thereof to within a liquid metal melt, said apparatus comprising (a) a crucible (1) having an interior adapted for containing said metal melt, and having an opening (2) through said crucible adapted for accessing the interior of said crucible, (b) an immersion pipe adapted for introducing said reactive metal or alloy thereof to within said melt, said pipe having an end exterior to said crucible and an end interior to said crucible, and passing through said opening (2), said immersion pipe being in communication with (c) an accommodating vessel (4) having an end proximal to said crucible and an end distal to said crucible, said vessel being adapted for storing said reactive element or alloy thereof, said proximal end optionally being adapted for heating said reactive metal or alloy thereof, (d) a pressure unit (5) at said distal end or said vessel adapted for exerting pressure through said immersion pipe and in the direction of said crucible (1), and (e) a heatable pipeline (7) adapted for proximate liquification of said reactive element or alloy thereof and passing of said reactive element or alloy thereof, in a liquid state, to said metal melt and disposed between and in communication with said immersion pipe (3) and said accommodating vessel (4).

14. An apparatus as defined in claim 13, wherein a coupling adapted for regulating the flow of reactive metal or alloy thereof or for interrupting the connection from said accommodating vessel to the interior of said crucible, is disposed between said heatable pipeline (7) and said immersion pipe (3).

* * * * *